United States Patent [19]

Rabinowitz

[11] 4,125,742

[45] Nov. 14, 1978

[54] TIERED CONVOLUTED SHIELDED INSULATORS

[75] Inventor: Mario Rabinowitz, Menlo Park, Calif.

[73] Assignee: Electric Power Research Institute, Inc., Palo Alto, Calif.

[21] Appl. No.: 802,603

[22] Filed: Jun. 2, 1977

[51] Int. Cl.[2] ..... H01B 17/50

[52] U.S. Cl. ..... 174/211; 174/212

[58] Field of Search ..... 174/211, 212

[56] References Cited

U.S. PATENT DOCUMENTS

| | | | |
|---|---|---|---|
| 1,750,318 | 3/1930 | Kaiser | 174/211 X |
| 1,854,459 | 4/1932 | Dienner | 174/211 |
| 1,994,282 | 3/1935 | Lusignan, Jr. | 174/212 X |
| 3,115,543 | 12/1963 | Morrison | 174/211 X |
| 3,207,840 | 9/1965 | Sharp | 174/211 X |
| 3,281,525 | 10/1966 | Sonnenberg et al. | 174/211 |

FOREIGN PATENT DOCUMENTS

| | | | |
|---|---|---|---|
| 1,209,690 | 10/1970 | United Kingdom | 174/212 |

*Primary Examiner*—Laramie E. Askin

*Attorney, Agent, or Firm*—Townsend and Townsend

[57] ABSTRACT

Optimized shielding configurations for longitudinally extended tiered insulators for electric power equipment is described. An insulator comprises a central core with a plurality of annular shields and radial partitions defining convoluted paths between the environment and the surface of the central core. An optimizing relationship of core diameter, tier separation, free path length and total path length between the outer surface and the inner core is disclosed for constructing insulators with maximum lifetime in contaminated environments. Selected generalized insulator configurations are disclosed which embody the invention. Also embodied in the invention is the addition of molecular sieve, insulating grease, or adhesives on the outer edges or lips to sorb out contaminants before they can reach the inner insulating surfaces.

8 Claims, 8 Drawing Figures

TIERED CONVOLUTED SHIELDED INSULATORS

This invention was made under contract with or supported by the Electric Power Research Institute, Inc., of Palo Alto, California.

BACKGROUND OF THE INVENTION

This invention relates to electrical standoff insulators for utility power applications. Specifically, the invention is relevant to configurations for standoff insulators which maximize insulator lifetime and reliability in contaminated environments.

Contaminants in the air and in many indoor environments may accumulate on electrical insulators, reducing the dielectric strength and electrical insulating ability leading to electrical breakdown. Breakdown, generally caused by flashover along the length of the insulator, is considered to be a serious problem. An industry standard for insulator performance in an overhead utility power transmission line calls for less than one flashover per hundred mile years of overhead transmission line. In a major three phase trunk line, there are typically 4 ½ towers per mile, with three lines per tower. Thus, according to industry standards, flashover can be expected in less than about one insulator out of 135 in each three mile system length during any 10 year period.

To maintain the industry standard, sturdy, long lifetime insulators are needed. In the past it has been necessary to frequently clean and occasionally replace contaminated insulators in a relatively costly maintenance program. Various alternative approaches have been suggested to minimize the likelihood of breakdown, the need for cleaning insulators, and ultimately the need to replace insulators. Among the approaches considered have been the use of a material on which the contaminants cannot adsorb, but this has not succeeded. Another approach is the use of semi-conductor material on the insulator through which a small current is permitted to flow, thereby heating the insulator in order to inhibit adsorption of contaminants. However, this introduces unnecessary power dissipation, and the semi-conductor deteriorates with time. These various approaches have not succeeded since a contaminant coating accumulates in any case, providing a low resistance path despite the type of dielectric material used.

SUMMARY OF THE INVENTION

In order to overcome the problems of contamination from atmospheric contaminants on utility power insulators, a generalized geometric configuration has been devised which is optimized in terms of relationships mathematically definable between the minimum acceptable gaseous conductance and relative diameters of the insulator, tier separation, path shapes and path lengths between the outer surface and the inner core of an insulator. The relations may be used within the constraints imposed by economics and mechanical requirements to maximize the useful electrical lifetime of the insulators.

As a result of these established relationships, insulators of any practical size can be constructed in a manner preserving the insulative characteristic of the electrical insulator. Various generalized configurations are disclosed which embody the invention. These configurations include a longitudinally extended core, annular or cylindrically extended circumferential shields about the core, and partitions protruding radially with respect to the core. The shields and the partitions are disposed in an overlapping spaced interleaving fashion to define a convoluted contaminant flow path between the exterior surfaces and the core to inhibit the migration of atomspheric fallout to the core. Such migration is also inhibited by the addition of insulating grease (e.g. silicone grease), molecular sieve (zeolite), or adhesives, on the exterior surfaces of the insulator to sorb out the contaminants. The voids between the shields and partitions define circuitous paths from the outer surface to the central core which together with preferential adsorption on the outer surfaces of the insulator act to reduce the contaminant pressure along the insulator core.

The invention will be best understood by reference to the following detailed description taken in conjunction with illustrative drawings of preferred embodiments.

DETAILED DESCRIPTION OF THE PREFERRED EMBODIMENTS

In order to more fully understand the concept of the invention, it is helpful to investigate the underlying principles governing the flashover phenomenon. In particular, the likelihood of flashover at a selected voltage differential between two points, e.g., between a high tension transmission line and its grounded support, is proportional to the length of separation between the line and the support, and the surface resistance of the separating device, i.e, the insulator.

The surface resistance depends upon a variety of factors, including the amount of contamination. The accumulation of contamination may be retarded by controlling the rate of inflow of contamination and by controlling the adsorption characteristics of the surfaces nearer the core and of the path between the exterior surface and the core of the insulator. For example, the core is preferably a non-adsorptive material, and the outer portions of the flow path are preferably relatively adsorptive in order to inhibit contaminants from migrating to the core.

1. MAXIMIZING SURFACE ELECTRICAL RESISTANCE IN AN ADVERSE ATOMSPHERIC ENVIRONMENT

To utilize the insulative properties of air to a maximum, e.g., in overhead transmission lines under adverse weather conditions, a general criterion for the design of a shielded insulator is to establish a breakdown path length across the surface of an insulator as a predetermined factor, $n$, times the air breakdown gap. Generally, the factor $n$ is about two to three, depending upon a variety of parameters including the size of the insulator.

To maximize the surface electrical resistance of the insulator to achieve a maximum useful lifetime, the entry or migration of contaminants may be reduced by limiting their spatial conductance from the exterior of the insulator to the interior core, and by adding grease or adhesive to the exterior surfaces of the insulator to sorb out the contaminants. This minimizes the adsorption of contaminants on the interior surface. Furthermore, increase of the total surface area decreases the density of contamination on the surface and helps to keep the surface resistance high. Additionally, the increased path length also helps to keep the surface resistance high. Therefore, according to the invention, the path length from the outer surface is increased while maintaining a relatively moderate outer radius. This is accomplished by convoluting, i.e. folding, the paths between the inner and outer surfaces of the insulator according to a predetermined relationship, and by the addition of high sticking probability material to the outer surfaces.

Figure 1:
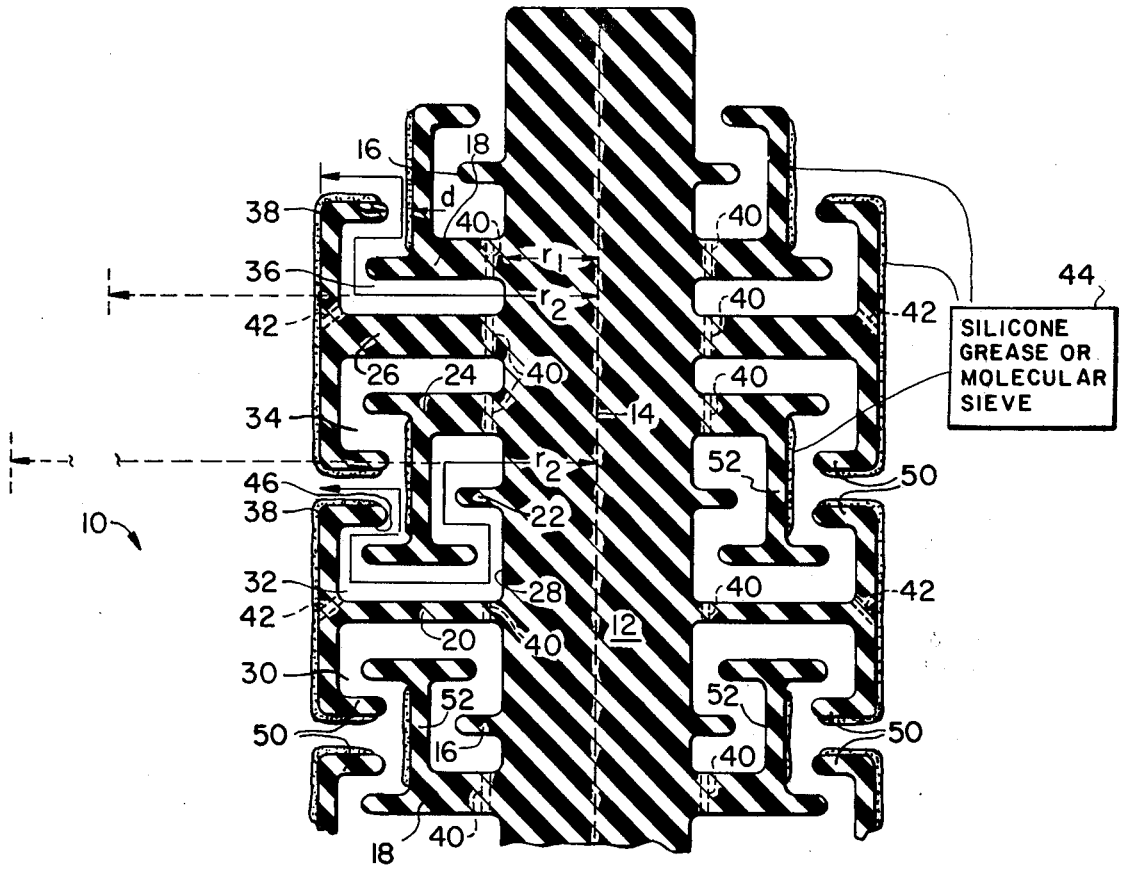
FIG. 1 is a longitudinal cross-sectional view of a generalized insulator configuration according to the invention.

Turning first to FIG. 1, an insulator 10 is illustrated in cross section in accordance with the invention. The insulator 10 comprises a right circular cylindrical core 12 longitudinally extending along a central axis 14 (shown in phantom) and further comprises members 16, 18, 20, 22, 24 and 26 extending radially from the surface 28 of core 12. The members 16, 18, 20, 22, 24, and 26 may include radially protruding partition portions 50 and longitudinally extended cylindrical portions or annular shields 52 which are separated from one another to define folded channels 30, 32, 34 and 36, respectively, each of varying lengths with a minimum width *d*. The inner core 12 has a radius of $r_1$ from axis 14 to inner surface 28. The distance from axis 14 to the outermost surface 38 along the folded channels may be referred to as a pseudo-radius $r_2$. Other pseudo-radii may be defined for the purposes of an analysis.

In the invention, the configuration of the insulator 10 minimizes the adsorption of contaminants along the inner surface 28 of core 12 by inhibiting the gas flow of contaminants from the exterior 38. Additionally, the addition of molecular sieve, insulating grease or other high sticking probability adhesives 44 shown on the outer surfaces of the insulator also serves this purpose. The reduction of contaminant gas flow is describable according to optimizing relationships between $r_1$, $r_2$, and *d*.

Since free path migration of contaminants or simply gas flow is directly proportional to the gaseous conductance C of suspended contaminants, the fundamental law of gas conductance for a right circular cylinder may be applied, namely:

$$C = \frac{4}{3}\,\frac{v}{\int_0^l \frac{H}{A^2}\,dl} \tag{1}$$

where

- $v$ is the mean molecular speed of the contaminants;
- H is the length of the perimeter of the channel between the core and the exterior surface;
- $l$ is the path length of the channel between the core and the exterior surface; and
- A is the surface area of an equivalent right circular annulus having radial dimension $l + r_1$, where $r_1$ is the core radius.

Applying equation (1) to the case illustrated in FIG. 1, where $l = r_2 - r_1$:

$$H = 2[(2\pi r_1 + 2\pi l) + d]$$

and $$A = (2\pi r_1 + 2\pi l)d$$

then for the conductance of each channel separately:

$$C = \left(\frac{4\pi d^2}{3}\right)\frac{v}{\left[\ln\left(\frac{r_2}{r_1}\right) + \frac{r_2}{r_1} - 1 + (2\pi r_1 + d)\left(\frac{1}{2\pi r_1} - \frac{1}{2\pi r_2}\right)\right]} \tag{2}$$

where ln is the natural logarithm.

The total gas conductance to the inner surfaces is arrived at by a simple summation of the individual conductances.

Equation (2) is a basic scaling formula for any longitudinally extended insulator having annular tiers and channels. To attain a comparable conductance for insulators of divergent lengths, radii, and channel separation, the scaling formula of equation (2) is merely adjusted to maintain a constant value for C.

In practical application, scaling equation (2) may be simplified by approximations. For example, consider the situation where the circumferential distance around the core 12 along the inner surface 28 is much greater than the channel width, i.e., $2\pi r_1 >> d$. In this specialized case:

$$C = \left(\frac{4\pi d^2}{3}\right)\frac{v}{\ln\left(\frac{r_2}{r_1}\right)} \tag{3}$$

Suppose further, that the channel width is changed by a constant, i.e., $D = nd$, where $r_1$ remains constant. Then:

$$\frac{D^2}{\ln\left(\frac{R_2}{r_1}\right)} = \frac{d^2}{\ln\left(\frac{r_2}{r_1}\right)} \tag{4}$$

where $R_2$ is the outer radius required to maintain a constant conductance. Solving for $R_2$:

$$R_2 = r_2\left(\frac{r_2}{r_1}\right)^{n^2 - 1} \tag{5}$$

which indicates that the scaling criterion is a non-linear and non-trivial relationship, as the different dimensions scale differently.

an exact calculation of the solution to the gas conductance scaling equation for insulators of the type shown in cross-section in FIG. 1 and illustrated schematically in FIGS. 2A–2G and the use of the solutions in practice becomes more difficult because of the many different paths and path lengths involved. To a reasonable degree of accuracy, however, conductance is approximately:

$$C = \left(\frac{4\pi d^2}{3}\right)\frac{v}{\left[\ln(1+K) + \left(\frac{1}{1+K}\right) - 1 + \left(1 + \frac{d}{2\eta r_1}\right)\left(1 - \frac{1}{1+K}\right)\right]} \tag{6}$$

where $l = Kr_1$ is the average path length from the inner surface 28 to the outer surface 38, K being a scaling factor. Equation (6) is a general scaling formula which may be used to optimize the design of any longitudinally extended insulator with respect to molecular or gas conductance.

In the case where $2\pi r_1 >> d_1$, then equation (6) is simplified to :

$$C = \frac{4\pi d^2}{3} \frac{\nu}{\ln(1+K)} \quad (7)$$

This expression may be used to analyze the geometry of a generalized tiered insulator, where the radius is related to the diameter as indicated.

Insulators made according to the criteria established by the scaling equation (7) are illustrated by FIGS. 1 and 2A-2G. The multiple functions of such insulators include the following: provision of a longitudinal convoluted creepage path; fixing of the rate at which pollution is deposited aerodynamically; fixing of the rate at which pollution runs off or is washed off (orifices 40 and 42); provision of vertical length in residual air-gaps 46 which remain when condensate forms on the partitions 50; and restraining drying and contaminant deposition preferentially to outer surfaces to maximize longitudinal surface electrical resistance. The use of drainage holes allows such additional functions as shedding of droplets; prevention of water and other fluid accumulation; ejection of water torrents caused by heavy rain or live washing; and maintenance of a long electrical creepage path. By means of both low conductance and high adsorption rate characteristics on the outermost parts of the insulator, contaminants in both molecular and particulate form are hindered from reaching the inside surfaces or core of the insulator.

2. MINIMIZING ADSORPTION ALONG A CONVOLUTED PATH

Adsorption of the contaminants along the flow path and ultimately at the inner surface 28 of the insulator 10 is a major limiting factor affecting the flashover probability. Whereas conductance is a rate criterion, the adsorption is an accumulative criterion. Breakdown is likely after an accumulation of contaminance; however, breakdown can be postponed by control of the adsorption characteristics of the contaminant path. The adsorption characteristics is definable on a molecular level.

Starting with the molecular collision frequency;

$$Z = \sigma \eta \nu = \nu/L \quad (8)$$

where

Z is the collision frequency per molecule; $\sigma$ is the collision cross section;

$\eta$ is the number of molecules per unit volume;

$\nu$ is the mean molecular speed; and

L is the mean free path between collisions.

It may be verified, at standard temperature and pressure, that it would require 100 seconds for a gas molecule to displace 10 centimeters in any direction. If the sidewalls of the tiered members of an insulator are spaced 1 centimeter apart, during that period about $10^6$ wall collisions per molecule would occur. Thus, wall adsorption along the flow path may be a significant factor in blocking atmospheric particles from contaminating the core of an insulator in the transient case, it can be verified that as a result of gas molecule collisions, the number of contaminant molecules along a directional path decreases exponentially according to the relation:

$$N = N_o e^{-l/L} \quad (9)$$

where

L is the mean free path length;

$l$ is the total path traversed;

$N_o$ is the number of contaminants in the atomsphere at the outer surface 38; and N is the number of molecules of contaminants attaining the inner surface 28 on the first pass. Thus, a long path length favors the adsorption of contaminants. Since it is impractical to achieve long path lengths simply by increasing the outer diameter of the insulator, the path length can be effectively lengthened by convoluting, i.e., folding, to reduce the overall diameter of the insulator 10. The convoluted path has the additional advantage of providing wall surfaces in the path of contaminants which are more likely to adsorp directional contaminant flow.

The gas conductance C in steady state is given by:

$$Q = (P_2 - P_l)C \quad (10)$$

where $P_2$ is the contaminant pressure at the outer surface;

$P_1$ is the contaminant pressure at the inner surface.

Assume for the worst case that contaminant adsorption occurs only at the inner surface with a sticking probability of $f$. Thus the rate of adsorption is $$R = f(\tfrac{1}{4}\eta_1 \nu), \quad (11)$$

where $\eta_1$ is the number density of contaminants at the inner surface.

The solution from equations (10) and (11) for the contaminant pressure at the outer surface 38 yields the following relationship:

$$P_2 = P_1 [\, 1 + \frac{3}{8} f \frac{r_1}{d} \ln (1 + K) \,] \quad (12)$$

For reasonable geometries, i.e., where $r_1 = 40d$, $f = \frac{1}{2}$ and $K = 100$, the contaminant pressure, and thus the adsorption, is reduced by about 100 times at the inner surface 28.

A simple example, neglecting desorption effects, illustrates how a reduction of contaminant pressure and attention to the path and surface adsorption characteristic decreases the likelihood of flashover in an electric insulator. Flashover is most likely when the inner surface 28 of the insulator 10 is saturated with a coverage of about $10^4$ monolayers of contaminant. Supposing the concentration of contaminants in the atmosphere to be about 1 part in $10^{10}$ and monolayer saturation coverage to be about $10^{15}$ molecules/cm$^2$, a flashover would occur within about 2 weeks with no conductance limitation to the inner insulator surfaces, whereas flashover would be retarded to about 3 years by limiting the conductance to the point where $P_2 \sim 100\ P_1$. Desorption effects make a precise calculation difficult. However, the example suffices to show the value of limiting the conductance to the inner surface, thereby increasing lifetime substantially.

Increased adsorption along the contaminant path and decreased adsorption at the innermost surface further enhances the mean time before failure. Viewing the inner surface as the last part of the insulator to be coated over by the contamination prior to flashover, the desired mean time before failure, T, may be expressed as follows:

$$T > \frac{4M}{\eta_2 v}\left[\frac{1}{f} + \frac{3}{8}\ \frac{r_1}{d}\ \ln(1 + K)\right] \tag{13}$$

where

M is the number of contaminant molecules per square cm at which flashover first is likely to occur:

$\eta_2$ is the numerical atmospheric density of contaminant;

$f$ is the sticking probability of the contaminants at the inner surface;

$r_1$ is the inner radius;

$d$ is the mean channel width; and $K$ is the inner surface to outer surface scaling factor. The bracketed term in equation (13) represents the amount by which the operating lifetime of an insulator may be increased over a straight cylindrical insulator of unity sticking probability. The bracketed variables in equation (13) may be adjusted to satisfy the requirements of a practical insulator while maximizing the insulator lifetime.

For example, insulating grease, a good adhesive and/or molecular sieve material may be employed at the other surfaces of the tiers to capture inflowing contaminants. The insulating grease may be any of a number of commercially available silicone greases which have reasonably high dielectric strength, and to which particles readily stick. Similar criteria would apply for adhesive materials.

Molecular sieve material would be used perferentially in areas where the contamination occurs more in molecular rather than particulate form. Zeolites are one type of molecular sieve material. The very strong sorptive forces in zeolites seem to be due primarily to the cations, which are exposed in the crystal lattice. These cations act as sites of strong localized positive charge which electostatically attract the negative end of polar molecules. The greater the dipole moment of the molecule, the more strongly it will be attracted and sorbed. Polar molecules are generally those which contain O, S, Cl, or N atoms, and are asymmetrical. For example, zeolites readily sorb carbon monoxide, and they sorb water more strongly than any other material.

Under the influence of the localized, strong positive charge on the cations, molecules can have dipoles induced in them. The polarized molecules are then sorbed strongly due to the electrostatic attraction of the cations. The more unsaturated the molecule, the more polarizable it is, and the more strongly it is adsorbed.

The rate at which a given gas is adsorbed on zeolite depends primarily on the following four variables (1) the rate at which the material being sorbed can diffuse to the activated crystals within the pellets or beads; (2) the relative size of the molecules and the zeolite pores; (3) the strength of the sorptive forces between the zeolite and the sorbate; and (4) the temperature.

The processes by which the other molecular-sieve materials operate are similar to that of zeolite, but perhaps not as well understood. A high degree of porosity is common to all the molecular-sieve materials. However, the zeolites are unique in the degree of uniformity of pore size and geometry. For example, activated carbon (which includes activated charcoal as one type) is a complex network of pores of varied shapes and sizes. The shapes include cylinders, rectangular cross sections, as well as many irregular shapes and constrictions. The pore size can range from less than 10 A. to over 100,000 A. in diameter.

3. REPRESENTATIVE INSULATOR CONFIGURATIONS

A number of practical insulator configurations are illustrated in the figures. In FIG. 1, a longitudinally symmetrical pattern having four different periodic convoluted paths between the core surface 28 and the outer surface 38 is illustrated.

Figure 2A:
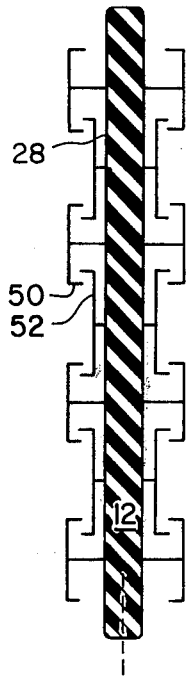
FIGS. 2A–2G schematically illustrate further insulator cross-sectional configurations according to the invention.
Figure 2B:
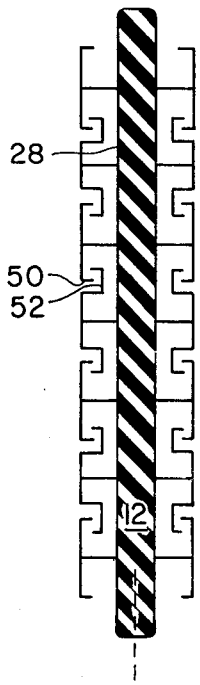
Figure 2C:
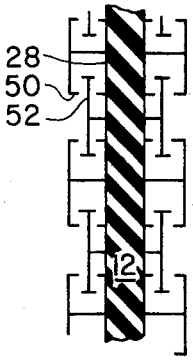
Figure 2D:
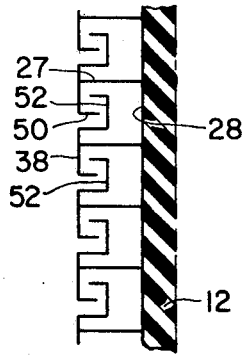
Figure 2E:
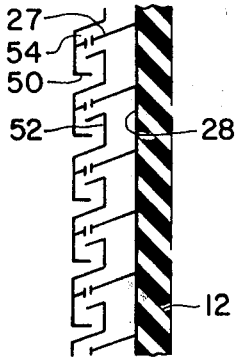
Figure 2F:
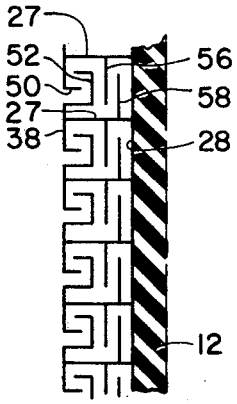
Figure 2G:
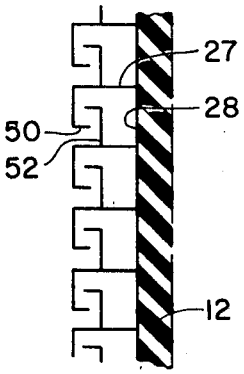

In FIGS. 2A, 2B, and 2C, a longitudinally symmetrical pattern of two paths to the inner surface 28 is illustrated. FIG. 2G corresponds to a longitudinally asymmetric pattern of the configuration of FIG. 2B, in which the insulator is specifically adapted to depend vertically. In each of the patterns illustrated, radial partitions 50 overlap a longitudinally extended inner annular shield 52 to form a particle trap having a minimum separation distance d. In FIGS. 2D, 2E, 2F, and 2G, the particle trap is generally directed so that vertically descending contaiminants, such as dust, ash, salt particles and the like, are inhibited from entering the paths leading to the core surface 28 of the core 12. FIG. 2E, for example, illustrates a further modification wherein radially extended members 27 slant downwardly from the core surface 28 to further inhibit the migration of heavier than air contaminants.

In practical designs, orifices 54 may be provided in each of the members 27 to drain moisture accumulated between the members. The orifices 54 are illustrated by way of example in FIG. 2E.

The geometries illustrated may be generalized to increase the average length of the path with further partitions adding to the convolution of the path. For example, in FIG. 2F, the outer radial partitions 50 and the inner annular shields 52 are provided near the outer surface 38, and additionally a pair of longitudinally overlapping members 56 and 58 are provided between the outer surface 38 and the inner surface 28. The members 56 and 58 extend longitudinally in an annulus from their radially extending members.

Each of the embodiments disclosed is configured in accordance with the principles established by the present invention. Other configurations will be suggested to those of ordinary skill in the art as a result of this disclosure. Therefore, it is not intended that the invention be limited, except as indicated by the appended claims.

I claim:

1. An insulator for overhead electrical transmission lines comprising:

a longitudinally extended right circular cylindrical core of insulative material having a first radius;

a plurality of radially protruding members circumscribing said core;

a plurality of cylindrical shields longitudinally extended about said core;

at least two of said members mounted to said core and protruding radially from said core intermediate of said core and of a radially exterior environment;

at least one of said shields mounted to each of said two members, each said shield longitudinally overlapping selected portions of said members such that said members and said shields define a plurality of longitudinal voids and a plurality of annular channels having a convoluted path between said radially exterior environment and said core and wherein the width of each channel is scaled relative to the length of said corresponding path for minimizing free path migration of contaminants from said exterior environment to said core in order to maximize electrical resistance of said insulator.

2. An insulator according to claim 1 wherein, for an arbitrary minimum acceptable gaseous conductance factor C of said exterior environment populated with gaseous suspended contaminants, convoluted path length and said channel widths of said insulator are scaled according to the following relation:

$$C = \frac{4\pi d^2}{3} \cdot \frac{v}{\left[\ln\left(\frac{r_2}{r_1}\right) + \frac{r_2}{r_1} - 1 + (2\pi r_1 + d)\left(\frac{1}{2\pi r_1} - \frac{1}{2\pi r_2}\right)\right]}$$

where $v$ is the mean molecular speed of the contaminants;

$r_1$ is the first radius of said core, $d$ is the mean channel width;

$r_2$ is an equivalent second radius equal to the sum of the length of one said convoluted path and $r_1$;

C is the gaseous conductance of the suspended contaminants.

3. An apparatus according to claim 2 further including partitions extending from the end margins of said members and said shields, and means for adsorption of contaminants along said channels, said adsorption means being disposed on said partitions and said shields adjacent said equivalent second radius.

4. An insulator according to claim 3 wherein for an arbitrary minimum acceptable mean time before failure, T, said electric insulator, said first radius, said equivalent second radius and the channel width are established by the relation:

$$T > \frac{4M}{\eta_2 v}\left(\frac{1}{f} + \frac{3}{8}\,\frac{r_1}{d}\ln(1+K)\right]$$

where $v$ is the mean molecular speed of the contaminants;

M is the number of contaminant molecules per square cm at which flashover is likely to occur;

$\eta_2$ is the numerical atmospheric density of said contaminant molecules;

$f$ is the sticking probability of said contaminant molecules at said core;

$r_1$ is the first radius;

$d$ is the mean channel width; and

K is a scaling factor equal to the ratio of said first radius to said second radius; and wherein said mean channel width is much less than the path length between said core and said radially exterior environment.

5. An insulator according to claim 3 wherein said adsorption means comprises an adhesive for capturing particulates.

6. An insulator according to claim 3 wherein said adsorption means comprises a molecular sieve material.

7. An insulator according to claim 1 wherein said members include longitudinal orifices therethrough for draining moisture accumulated between the members.

8. An insulator according to claim 7 wherein said shields and said members define particle trapping means for inhibiting vertically descending contaminants from entering said channels leading to said core.

* * * * *